US007347529B2

(12) United States Patent
Cheng et al.

(10) Patent No.: US 7,347,529 B2
(45) Date of Patent: Mar. 25, 2008

(54) COMPOUND INKJET PRINT HEAD PRINTER

(75) Inventors: Kevin Cheng, Hsinchu (TW); Chih-Jian Lin, Hsinchu (TW); Yi-Je Chen, Hsinchu (TW); Yu-Chu Huang, Hsinchu (TW); Andy Chen, Hsinchu (TW)

(73) Assignee: Industrial Technology Research Institute, Hsinchu (TW)

( * ) Notice: Subject to any disclaimer, the term of this patent is extended or adjusted under 35 U.S.C. 154(b) by 102 days.

(21) Appl. No.: 10/725,416

(22) Filed: Dec. 3, 2003

(65) Prior Publication Data

US 2005/0046680 A1 Mar. 3, 2005

(30) Foreign Application Priority Data

Aug. 26, 2003 (TW) ..... 92123443 A

(51) Int. Cl.
*B41J 2/15* (2006.01)

(52) U.S. Cl. ..... 347/40

(58) Field of Classification Search ..... 347/43, 347/40, 15, 42
See application file for complete search history.

(56) References Cited

U.S. PATENT DOCUMENTS 5,208,605 A * 5/1993 Drake ..... 347/15
5,412,410 A * 5/1995 Rezanka ..... 347/15
5,479,196 A 12/1995 Inada
5,600,349 A 2/1997 Keefe
5,700,315 A 12/1997 Wenzel
5,745,131 A * 4/1998 Kneezel et al. ..... 347/15
5,856,835 A 1/1999 Umeda et al.
5,886,715 A 3/1999 Fukuoka
5,900,889 A 5/1999 Tsukuda
6,020,905 A 2/2000 Cornell et al.
6,033,060 A 3/2000 Minami
6,036,299 A 3/2000 Kobayashi et al.
6,042,218 A 3/2000 Nakahara
6,062,681 A 5/2000 Field et al.
6,145,952 A 11/2000 Sharma et al.
6,179,406 B1 1/2001 Ito et al.
6,193,355 B1 2/2001 Nakamura
6,213,581 B1 4/2001 Hasegawa et al.
6,276,778 B1 8/2001 Katayama
6,283,573 B1 9/2001 Nakamura
6,296,342 B1 10/2001 Oikawa
6,312,087 B1 11/2001 Imai et al.
6,312,089 B1 11/2001 Imai
6,322,185 B1 11/2001 Asano et al.
6,334,662 B2 1/2002 Hollands (Continued)

OTHER PUBLICATIONS

W. E. Althauser et al., dual Resolution ink Jet Drum Printer, Dec. 1980, vol. 23, No. 7A, pp. 2700-2702.*

*Primary Examiner*—K. Feggins
(74) *Attorney, Agent, or Firm*—Birch, Stewart, Kolasch & Birch, LLP

(57) ABSTRACT

A compound inkjet print head printer has a compound print head module. The compound print head module includes at least two inkjet print heads for providing ink droplets of one color but with different sizes. Since the compound inkjet print head module provides different sizes of ink droplets in a swath, the number of print swaths can be decreased. The compound inkjet print head printer increases a printing speed with high photo quality.

10 Claims, 8 Drawing Sheets

U.S. PATENT DOCUMENTS 6,336,700 B1 1/2002 Hays et al.
6,357,852 B1 3/2002 Premnath et al.
6,382,764 B1 5/2002 Shimoda
6,386,677 B1 5/2002 Imai et al.
6,406,125 B1 6/2002 Jackson
6,457,802 B2 10/2002 Jackson
6,554,398 B2 * 4/2003 Wyngaert et al. ..... 347/42
6,896,357 B2 * 5/2005 Murakami et al. ..... 347/43
2001/0028374 A1 10/2001 Ogawa et al.
2001/0050697 A1 12/2001 Jackson
2002/0005874 A1 1/2002 Imai et al.

* cited by examiner

| | | | | | | | |
|---|---|---|---|---|---|---|---|
| 3 | 3 | 2 | 2 | 1 | 1 | 0 | 0 |
| 3 | 3 | 2 | 2 | 1 | 1 | 0 | 0 |
| 2 | 2 | 2 | 2 | 1 | 1 | 0 | 0 |
| 2 | 2 | 2 | 2 | 1 | 1 | 0 | 0 |
| 1 | 1 | 1 | 1 | 1 | 1 | 0 | 0 |
| 1 | 1 | 1 | 1 | 1 | 1 | 0 | 0 |
| 0 | 0 | 0 | 0 | 0 | 0 | 0 | 0 |
| 0 | 0 | 0 | 0 | 0 | 0 | 0 | 0 |

FIG. 3

| | | | | | | | |
|---|---|---|---|---|---|---|---|
| 8 | 8 | 5 | 5 | 1 | 1 | 0 | 0 |
| 8 | 8 | 5 | 5 | 1 | 1 | 0 | 0 |
| 5 | 5 | 5 | 5 | 1 | 1 | 0 | 0 |
| 5 | 5 | 5 | 5 | 1 | 1 | 0 | 0 |
| 1 | 1 | 1 | 1 | 1 | 1 | 0 | 0 |
| 1 | 1 | 1 | 1 | 1 | 1 | 0 | 0 |
| 0 | 0 | 0 | 0 | 0 | 0 | 0 | 0 |
| 0 | 0 | 0 | 0 | 0 | 0 | 0 | 0 |

FIG. 4

COMPOUND INKJET PRINT HEAD PRINTER

This Nonprovisional application claims priority under 35 U.S.C. 119(a) on Patent Application No. 092123443 filed in TAIWAN on Aug. 26, 2003, the entire contents of which are hereby incorporated by reference.

BACKGROUND OF THE INVENTION

1. Field of Invention

The invention relates to a compound inkjet print head printer, and particularly to a compound inkjet print head printer that operates with increased speed and high photo quality.

2. Related Art

A conventional inkjet printer ejects ink droplets at predetermined positions to form texts or images by moving its print head back and forth on a printing medium. The size, shape, material, concentration and position of the ink droplets from the print head are critical to the printing quality.

Printing photos by using inkjet printers is becoming more and more popular. Therefore, the printing resolution and color representation are increasingly more important. The resolution of an inkjet printer is measured by dots per inch of the printing medium. The higher the resolution, the finer the layout is with a smoother rim of the image. Furthermore, the color representation is based on gradations in a single pixel. A gradation means a level of color. High gradation has fine continuous levels of color and is rich in color variation. Hewlett-Packard has proposed photo resolution increasing technology for high-gradation photo printing. The print head repeatedly moves back and forth to eject one or more ink droplets at a single pixel according to color darkness. For example, if a dark red ink dot is wanted, then two or more red ink droplets are superimposed on the same dot. To prevent the resolution from being affected by the multiple ink droplets at a single pixel, the position of the ink droplets, the size of the ink droplets, and the number of ink droplets usually has to be accurately controlled, and the print head has to be compatible with the printing system. The smaller the ink droplets and the finer the pitch between ink droplets, the clearer the formed image. The image resolution is thereby increased and the gradation is much closer to reality. Generally, the smaller the ink droplets, the greater the number of ink droplets to fill up the pixel. As a result, the number of movements of the print head back and forth on the printing medium is increased, while the printing speed is lowered.

The problem of lower printing speed has been solved by changing the structure of the print head so that different sizes of ink droplets are ejected. For example, U.S. Pat. No. 6,020,905 discloses a thermal bubble type print head in which a heater is mounted to allow the print head to eject different sizes of ink droplets. However, mounting the heater in the print head increases the structural complexity and the production cost of the print head. U.S. Pat. No. 6,322,185 controls the voltage of a piezoelectric print head by a printing system to generate different amounts of piezoelectric vibration to eject ink droplets of different sizes. The above disclosures involve ejecting different sizes of ink droplets in different swaths, which limits the increase in printing speed.

Another solution is to provide nozzles of different sizes on the print head. For example, U.S. Pat. No. 5,412,410 forms two sets of jet holes on one print head to provide various sizes of ink droplets. Such a print head has a complex structure, such as at least two different sizes of jet holes, and actuators are mounted on one surface of the print head to provide different sizes of ink droplets simultaneously so as to increase the printing speed. However, for a given print area, various sizes of jet holes are arranged on the print head with a limited number. This increases the production and design cost while failing to effectively increase the printing speed and resolution.

SUMMARY OF THE INVENTION

An object of the invention is therefore to provide a compound inkjet print head printer, in which a compound print head module is mounted including inkjet print heads for providing different sizes of ink droplets, so as to provide ink droplets of at least two sizes in one swath, thereby reducing the number of strokes while increasing the printing speed.

The invention provides a compound print head printer having a compound print head module. The compound print head module includes inkjet print heads of different sizes to provide different sizes of ink droplets at one pixel position. In one swath, the inkjet print heads work depending on the volume of the ink droplets required for the target pixel. The large sized print head provides ink droplets with a larger volume than the small print head, thereby the number of strokes and the printing time are reduced when the pixel is dark. With the combination of the ink droplets from different sizes of inkjet print heads, the change in gradations is contrasted and the printing speed is increased to satisfy the demand of high photo quality. Furthermore, the compound print head module does not increase the complexity of both the print heads and the whole printing system, and does not require a higher production cost.

The compound inkjet print head printer with a compound print head module according to the invention has a compound print head module including first and second print heads. The volume of ink droplets from the first print head is N pico-liters (pl.), and the volume of ink droplets from the second print head is M pl, wherein N is larger than M. The ink droplets from the first and second print heads have at least one color. In the case of N=2M, the gradations are accomplished either by operating the second print head twice or by operating the first print head once. The first print head operates in association with the second print head to provide ink droplets required for the gradations with a reduced number of operations of the first and second print heads when a high amount of ink is needed at a given pixel. The human eye is less sensitive to color change than light change. After testing, if ink droplets of small and large sizes are within a reasonable range, they produce similar optical contrasts that cannot be distinguished by the human eye. The compound print head module achieves the same printing quality and layout colors as the prior art with a reduced number of operating passes.

Further scope of applicability of the invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

FIG. 3 is a data list of primary gradations of each pixel according to one embodiment of the invention;

FIG. 4 is a list illustrating the size and number of ink droplets for each pixel.

DETAILED DESCRIPTION OF THE INVENTION

Figure 1:
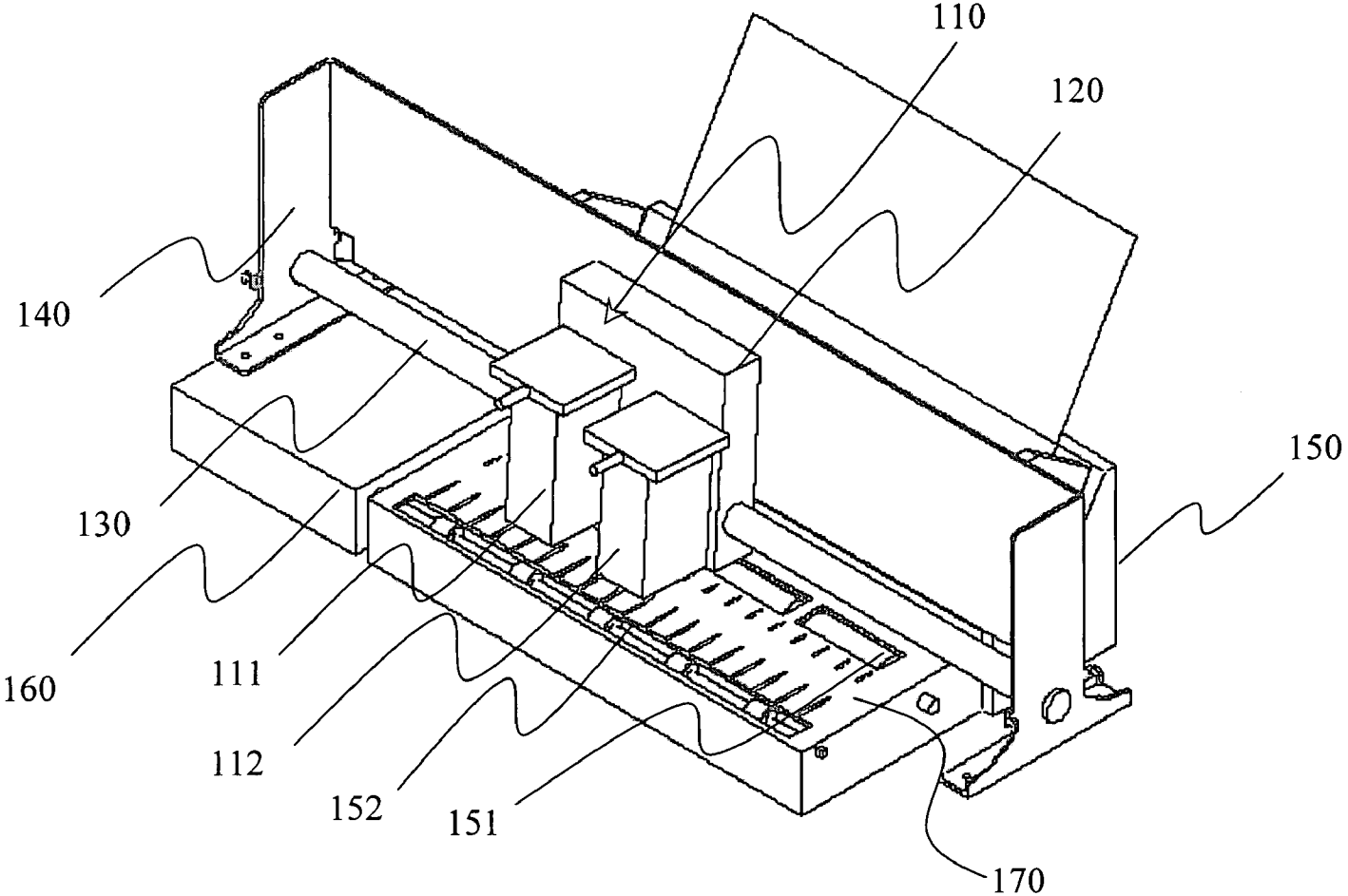
FIG. 1 is a schematic view of a print head module according to one embodiment of the invention.

FIG. 1 is a schematic view of a printer with compound inkjet print head according to one embodiment of the invention. A printer of the invention includes a compound inkjet print module 110 having first and second inkjet print heads. A first inkjet print head 111 of the inkjet print head module has a size of N pl. (pico-liters). A second inkjet print head 112 has a size of M pl. In this embodiment, N is twice M (N=2M). The first inkjet print head 111 and the second inkjet print head 112 are respectively mounted on a transversal tuning mechanism in a cartridge 120. A guide rod 130 penetrates through the cartridge 120 to allow transversal movement of the cartridge 120 along the guide rod 130. The guide rod 130 is fixed onto a frame 140 of the printer. A paper tray 150 is mounted at the rear side of the frame 140 to hold the paper to be printed.

Figure 2:
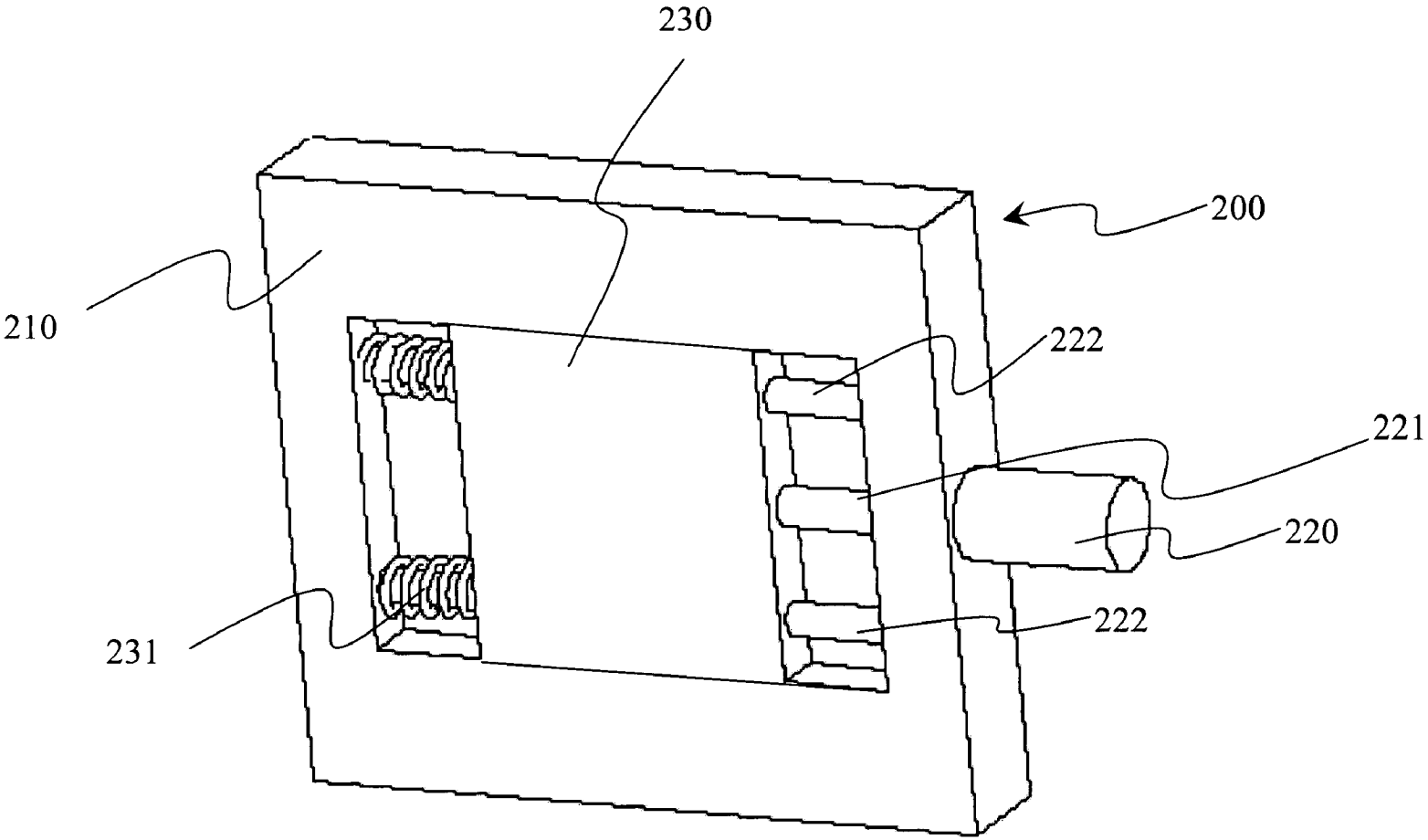
FIG. 2 is a schematic view of a tuning mechanism according to one embodiment of the invention.

An ink-detecting module 160 is mounted inside the printer to check the operation and relative position of the first inkjet print head 111 and second inkjet head 112 before ink drop ejection. Then, the distance between the inkjet print heads is adjusted by the tuning mechanism. Paper is fed from the paper tray 150 to a printing platform 170 under the compound ink jet print head module 110 by means of a feeding roller 151 to undergo printing. After the printing process is completed, the paper is delivered outside by means of a delivering roller 152. If the ink detecting module 160 determines that printing misalignment or any other problem has occurred with the first inkjet print head 11 and/or the second inkjet print head 112, the tuning mechanism adjusts the distance between the first inkjet print head 111 and the second inkjet print head 112 to maintain ink droplet ejection on the paper with high quality. FIG. 2 is a schematic view of a tuning mechanism according to one embodiment of the invention. The tuning mechanism 200 includes a base 210, a screw-adjusting device 220 and a sliding piece 230. The screw-adjusting device 220 is mounted on the base 210 so as to abut the sliding piece 230 through a top rod 221. When the screw-adjusting device 220 rotates, the top rod 221 is driven to push the sliding piece 230 forward. The sliding piece 230 slides with the help of a guide rod 222. Two springs 231 abut one side of the sliding piece 230 opposite to the guide rod 222 to achieve distance tuning. The first inkjet print head 111 and the second inkjet print head 112 are respectively mounted on their corresponding sliding pieces of the tuning mechanism. The base of the tuning mechanism is fixed on the cartridge. The tuning mechanism is, for example, a motor control module that automatically compensates the pitch between different ink jet head positions.

The inkjet print head has to repeatedly move forward and backward across the paper sheet to complete printing with multiple gradations. When the inkjet print head moves forward and returns to its initial position, it is called a print stroke. The number of ink droplets is determined according to the gradation of each pixel. At the position of each pixel, the ink droplets are or not ejected during one stroke. If the number of ink droplets required for the highest gradation is X, the number of print strokes is X. The higher the gradation, the slower the printing speed. However, the number of strokes is reduced with the different sizes of ink droplets provided by the inkjet print head module of the printer according to the invention. It is assumed that in the invention the first inkjet print head provides N pl. (pico-liters) of ink droplets and the second inkjet print head provides M pl. of ink droplets, wherein N=2M, while the size of an ink droplet from a conventional inkjet print head is M pl. While 5M pl. of ink droplets are required to fill up one pixel by five passes of the ink jet in the prior art, with the inkjet print head module of the invention the first inkjet print head runs twice and the second inkjet print head runs once to provide sufficient quantity (2N+M=5M). The ratio of sizes of ink droplets provided by the first inkjet print head and the second inkjet print head can vary in a similar manner, such as 3:1 or 4:1. Thereby, the number of passes of the first and second inkjet print heads is reduced from 5 to 2 or 3. The first and second inkjet print heads can be operated in the same print stroke to further reduce the number of print strokes. Table 1 shows minimal numbers of print strokes obtained at different target concentrations of 0, 1M, 5M, and 8M.

TABLE 1

| | Ink droplets of one size | First embodiment | | Second embodiment | | Third embodiment | |
|---|---|---|---|---|---|---|---|
| | | Ratio of sizes of ink droplets (pl.) | | | | | |
| | M | M:N = 1:2 | | M:N = 1:3 | | M:N = 1:4 | |
| Target concentration | M droplets | M droplets | N droplets | M droplets | N droplets | M droplets | N droplets |
| 0 | 0 droplet | 0 droplet | 0 droplet | 0 droplet | 0 droplet | 0 droplet | 0 droplet |
| 1 M | 1 droplet | 1 droplet | 0 droplet | 1 droplet | 0 droplet | 1 droplet | 0 droplet |
| 5 M | 5 droplets | 1 droplet | 2 droplets | 2 droplets | 1 droplet | 1 droplet | 1 droplet |
| 8 M | 8 droplets | 0 droplet | 4 droplets | 2 droplets | 2 droplets | 0 droplet | 2 droplets |
| Number of print strokes | 8 | 4 | | 2 | | 2 | |

In Table 1, when the size ratio of the ink droplets (M:N) reaches 3:1 or 4:1, only 2 print strokes are required to complete the printing. The printing speed of the invention is four times faster than using ink droplets of one size, without needing a complex structure of the inkjet print head. Photo quality with high gradation is thus obtained.

Hereinafter multi-dot printing is described. The compound inkjet print head module of the invention has to repeatedly move back and forth across the sheet of paper. The numbers of ink droplets from the first and second inkjet print heads are determined according to the gradation of each pixel. In each print stroke, each of the first and second print heads may or may not eject ink droplets. When the number of ink droplets corresponding to the highest gradation is 8, 8 print strokes are required for each position on the paper sheet in the prior technology. FIG. 3 is a data list of primary gradations of each pixel for 2-bit half-toned data. Each pixel position is expressed by a value between 0-3, each value representing the number of ink droplets in a conventional multiple ink-drop printing. FIG. 4 is a list illustrating the size and number of ink droplets for each pixel. That is, gradations 0, 1, 2, 3 are printed respectively by 0, 1, 5, 8 ink droplets, which respectively have a volume of 0, 1, 5, 8 M.pl in the art.

It is assumed that the volume (N picoliters [pl.]) of ink droplets for each print stroke of the first print head is twice the volume (M pl.) of ink droplets for each print stroke of the second print head. With the print head module according to the invention, the gradation 0, which needs 0 M pl ink droplets in the prior art, is printed with 0 N pl ink droplets from the first print head and 0 M pl ink droplets from the second print head. The gradation 1, which needs 1 M pl ink droplets in the prior art, is printed with 0 N pl ink droplets from the first print head and 1 M pl ink droplets from the second print head. The gradation 2, which needs 5 M pl ink droplets in the prior art, is printed with 2 N pl ink droplets from the first print head and 1 M pl ink droplets from the second print. head. The gradation 3, which needs 8 M pl ink droplets in the prior art, is printed with 4 N pl ink droplets from the first print head and 0 M pl ink droplets from the second print head. Printing for each pixel is accomplished by cooperation of the first and second print heads with reduced print strokes.

FIGS. 5 through 8 are schematic views illustrating the printing operation of the print head module according to the invention.

Figure 5:
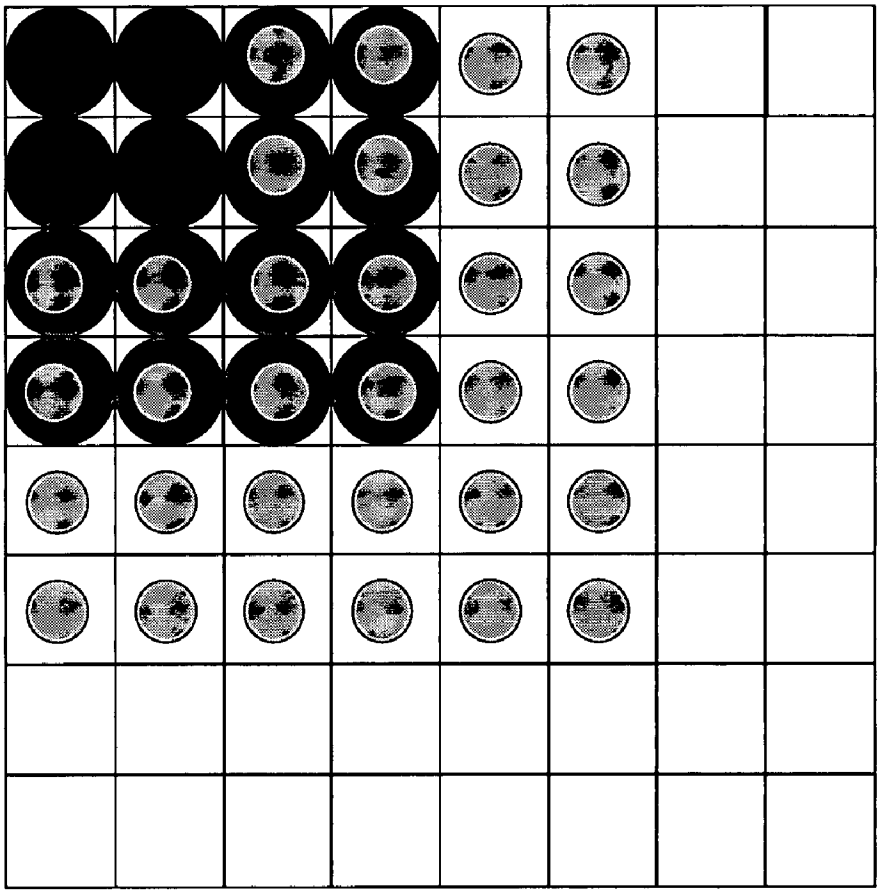
FIG. 5 through 8 are schematic views illustrating the printing operation of the print head module according to the invention.

Referring to FIG. 5, in the first print stroke of the print head module, the first print head ejects ink droplets at the position on the paper sheet corresponding to gradation 2 and gradation 3, and the second print head ejects ink droplets at the position on the paper sheet corresponding to pixel gradation 1 and gradation 2.

Figure 6:
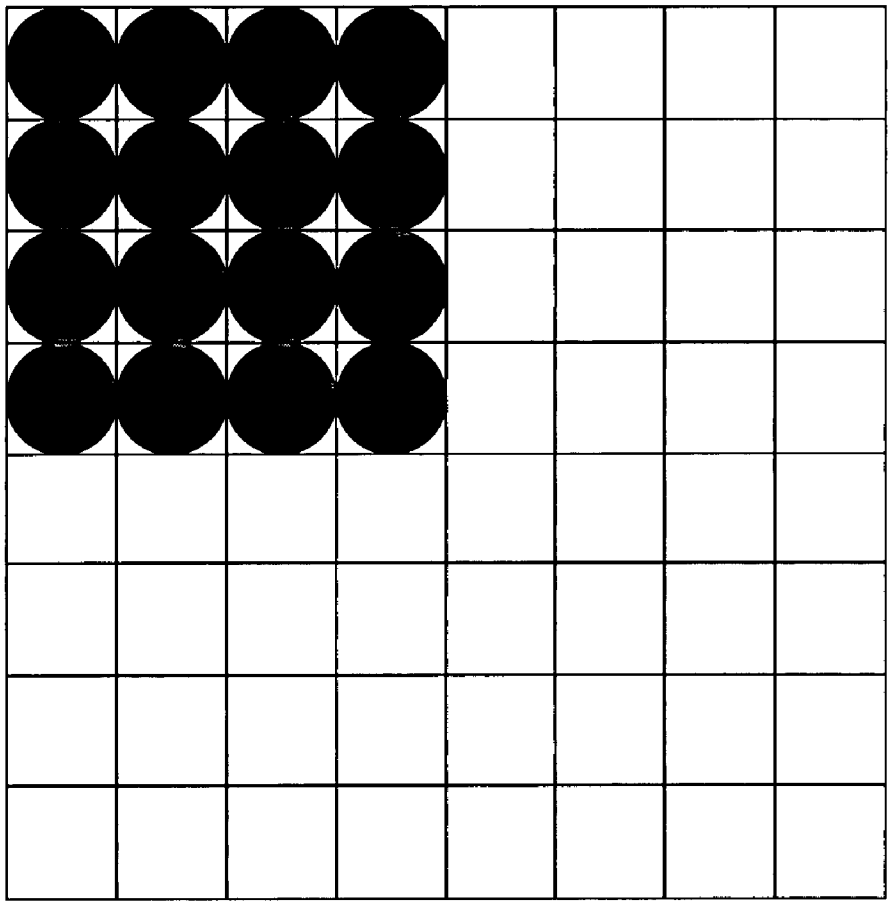

Referring to FIG. 6, in the second print stroke of the print head module, the first print head ejects ink droplets at the position on the sheet of paper corresponding to gradation 1 and gradation 2.

Figure 7:
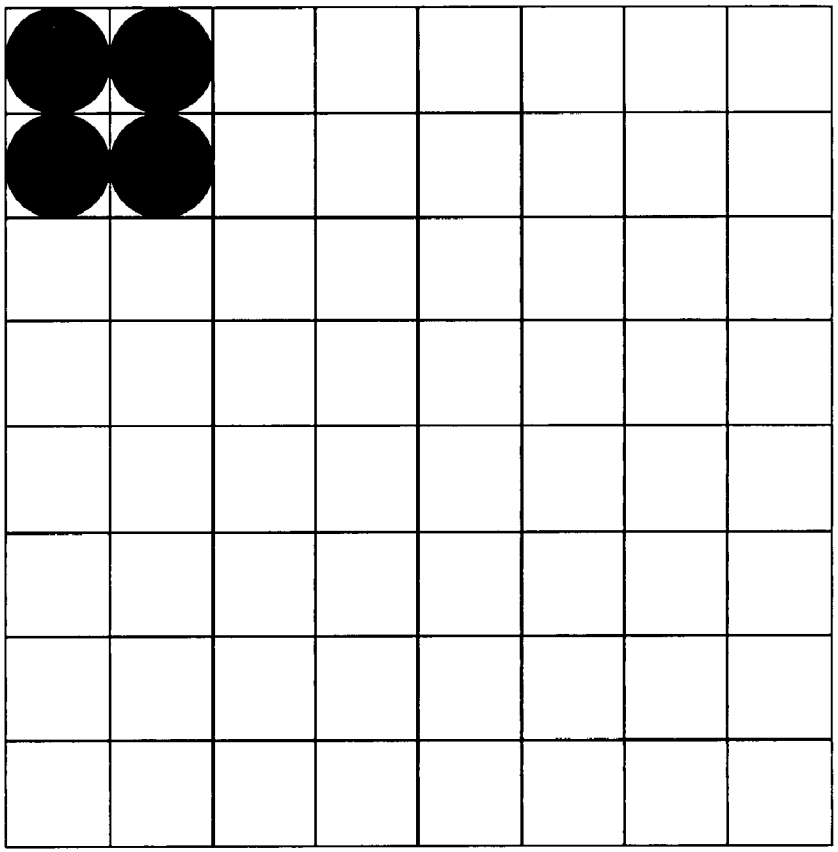

Referring to FIG. 7, in the third print stroke of the print head module, the first print head ejects ink droplets at the position corresponding to gradation 3.

Figure 8:
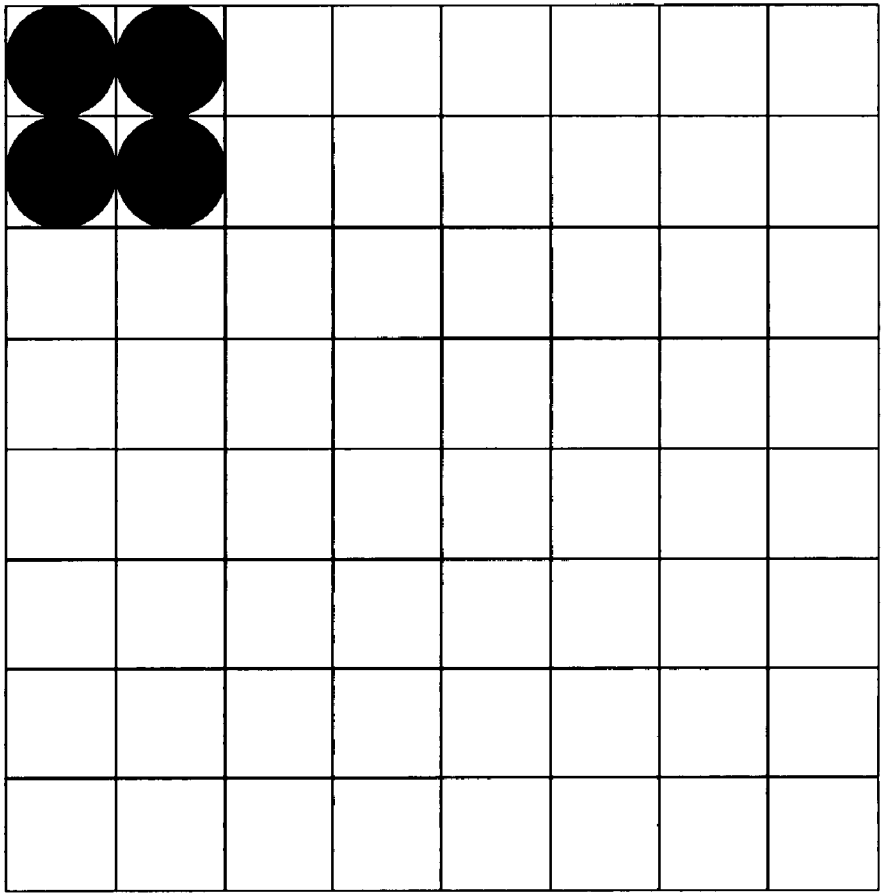

Referring to FIG. 8, in the fourth print stroke of the print head module, the first print head ejects at the position corresponding to gradation 3.

All ink droplets are filled at proper positions in four print strokes to complete the printing of gradations 0, 1, 5, 8.

The invention being thus described, it will be obvious that the same may be varied in many ways. Such variations are not to be regarded as a departure from the spirit and scope of the invention, and all such modifications as would be obvious to one skilled in the art are intended to be included within the scope of the following claims.

What is claimed is:

1. A compound inkjet print head printer with a compound print head module, being characterized in that the compound print head module includes at least two print heads to provide ink droplets of a same color but with different sizes of ink droplets, and an ink-detecting module to directly determine the operation and relative distance between the print heads of the compound print head module before ink droplet ejection, said print heads being mounted on a tuning mechanism to adjust the relative distance between the print heads in response to the ink detecting module, so that the compound print head module simultaneously provides ink droplets of at least two sizes in a print drop to form multi-gradation pixels with a reduced number of print strokes and an increased printing speed.

2. The printer of claim 1, further comprising more than one tuning mechanism.

3. The printer of claim 1, wherein the tuning mechanism includes a base, a screw-adjusting device and a sliding piece, the screw-adjusting device is mounted on the base in a manner to abut against the sliding piece through a top rod, so that when the screw-adjusting device rotates, the top rod is driven to push the sliding piece forth; two springs abutting against a side of the sliding piece opposite to the top rod to achieve distance tuning; and the print heads being respectively mounted on their corresponding sliding pieces of the tuning mechanism.

4. The printer of claim 3, wherein the tuning mechanism further includes two guide rods parallel to said top rod.

5. The printer of claim 1, wherein the tuning mechanism is a motor control module.

6. A compound inkjet print head printer with a compound print head module, being characterized in that the compound print head module includes first and second print heads, and an ink-detecting module to directly determine the operation and relative distance between the first and second print heads of the compound print head module before ink droplet ejection, said print heads being mounted on a tuning mechanism to adjust the relative distance between the print heads in response to the ink detecting module, wherein the volume of ink droplets from the first print head is N pico-liter (pl), the volume of ink droplets from the second print head is M pl, N being larger than M, the ink droplets from the first and second print heads having at least one color, various gradations at proper pixel positions being printed with a combination of N pl ink droplets from the first and M pl ink droplets from the second print head.

7. The printer of claim 6, further comprising more than one tuning mechanism.

8. The printer of claim 6, wherein the tuning mechanism includes a base, a screw-adjusting device and a sliding piece, the screw-adjusting device is mounted on the base in a manner to abut against the sliding piece through a top rod, so that when the screw-adjusting device rotates, the top rod is driven to push the sliding piece forth; two springs abutting against a side of the sliding piece opposite to the top rod to achieve distance tuning; and the first inkjet print head and the second inkjet print head being respectively mounted on their corresponding sliding pieces of tuning mechanisms.

9. The printer of claim 8, wherein the tuning mechanism further includes two guide rods parallel to said top rod.

10. The printer of claim 6, wherein the tuning mechanism is a motor control module.

* * * * *